US005906869A

United States Patent [19]

Thomas

[11] Patent Number: 5,906,869

[45] Date of Patent: May 25, 1999

[54] COLLAPSIBLE ARTIFICIAL CHRISTMAS TREE

[76] Inventor: Joyce Thomas, 111 Bristol La., Naples, Fla. 33962

[21] Appl. No.: 09/027,872

[22] Filed: Feb. 23, 1998

[51] Int. Cl.[6] ..... A47G 33/06

[52] U.S. Cl. ..... 428/9; 428/20; 428/27; 211/195; 211/196

[58] Field of Search ..... 428/9, 18, 20, 428/27; 211/195, 196

[56] References Cited

U.S. PATENT DOCUMENTS

| | | | |
|---|---|---|---|
| 3,064,379 | 11/1962 | Hertzberg | 41/15 |
| 3,674,612 | 7/1972 | Gehl, Jr. | 161/23 |
| 3,677,867 | 7/1972 | Westlund | 161/14 |
| 4,968,541 | 11/1990 | McCrory | 428/9 |

*Primary Examiner*—Alexander S. Thomas
*Attorney, Agent, or Firm*—Brinks Hofer Gilson & Lione

[57] ABSTRACT

An artificial decorated and lighted Christmas tree (10) which is concentrically collapsible into a shallow open-topped box for storage. When displayed, the artificial tree (10) is preferably hung from a ceiling or other overhead support. The skeleton of the tree consists of a flat disk (15), a member (16) projecting upwardly from the center of the disk (15) from which the artificial tree (10) is suspended, a cylindrical crown (24) of garland supported on the disk, (15), at least three rigid wire loops (20, 30, 40) having different diameters, and at least three flexible cords (18A, 18B, 18C, 18D, 22A, 22B, 22C, 22D, 32A, 32B, 32C, 32D) affixed to equally spaced apart edge segments of the disk (15) and to equally spaced apart segments of each one of the rigid wire loops (20, 30, 40). The skeleton of the tree is completely hidden from view by an elongated garland (26) of artificial conifer needles which may include traditional Christmas ornaments and electric lights which is wound successively around each one of the spaced apart rigid wire loops (20, 30, 40) to completely cover and hide the disk (15) and all the flexible cords (18A, 18B, 18C, 18D, 22A, 22B, 22C, 22D, 32A, 32B, 32C, 32D) and rigid wire loops (20, 30, 40) thereby creating an artificial conical Christmas tree (10).

5 Claims, 3 Drawing Sheets

COLLAPSIBLE ARTIFICIAL CHRISTMAS TREE

TECHNICAL FIELD

My invention lies in the field of artificial trees and more particularly to an artificial fully decorated and lighted Christmas tree which can be concentrically collapsed into a shallow open topped box for storage.

BACKGROUND ART

Artificial Christmas trees have been on the market for many years and a number of patents have been granted for artificial trees which can be collapsed into a shallow container for storage in minimal space until the next Christmas season.

Several suggestions have been made for a collapsible artificial tree which, when displayed, is hung from the ceiling or a beam. See, for example, Erickson U.S. Pat. No. 2,731,752; Westlund U.S. Pat. No. 3,677,867; and McCrory U.S. Pat. No. 4,968,541. However, I am not aware of any public offering of a collapsible artificial Christmas tree, particularly a truly conical evergreen conifer tree whose needles fully cover and hide the supporting skeleton of the artificial tree.

Therefore, a need exists for an artificial conical Christmas tree which, at the end of a Christmas season, can be readily collapsed and stored with all its decorations and lights in a shallow box until next Christmas.

DISCLOSURE OF THE INVENTION

I have invented and constructed a collapsible artificial Christmas tree which, when displayed, is hung from a ceiling or other overhead structure.

My tree may be marketed both with and without traditional Christmas ornaments and electric lights installed on the artificial tree. In either case, when the Christmas season is over, the tree is taken down, held over an open-topped box with horizontal dimensions greater than the maximum diameter of the tree, and the tree lowered and collapsed concentrically into the box for storage.

My collapsible conical Christmas tree is made from the following six components and materials: a flat rigid disk; a member attached to the center of the disk which projects upwardly with its upper end designed to be suspended from a ceiling or other overhead structure; a conical crown made of artificial green conifer needles supported by the disk and surrounding the lower portion of the upwardly projecting member; a plurality of circular rigid wire loops each having a different diameter; a plurality of elongated flexible cords or wires; and an elongated garland of artificial green conifer stems and needles.

As used in this application, "garland" means a rope or tightly wound collection of artificial pine or other conifer stems and needles traditionally used to decorate fireplace mantles, stairway banisters and porch railings at Christmas time.

The artificial tree is constructed by first attaching to the center of the flat rigid disk the member which projects upwardly from the disk and suspending the member and disk from a suitable overhead structure. Next, at least three equal lengths of flexible cord are affixed to three equally spaced apart edge segments of the horizontally oriented disk and then the lower ends of the flexible cords are affixed to equally spaced apart segments of the rigid wire loop which has the smallest diameter.

In one preferred embodiment of my invention, the flat disk has a diameter of three inches (7.62 cm) and there are four flexible cords each about ten inches (25.4 cm) long between the disk and the wire loop. The wire loop has a diameter of nine inches (22.86 cm) and thus the angle formed by the two cords depending from opposite sides of the disk is about 36 degrees, which is an ideal angle of slope for a conical Christmas tree.

To complete the skeleton of this embodiment of my artificial tree, the upper ends of four flexible cords each six inches (15.24 cm) long are affixed to 90-degree spaced apart segments of the nine-inch (22.86 cm) diameter wire loop and the lower ends of the four cords are affixed to 90-degree spaced apart segments of a 12-inch (30.48 cm) diameter wire loop. Then the upper ends of four more flexible cords each six inches (15.24 cm) long are affixed to 90-degree spaced apart segments of the 12-inch (30.48 cm) diameter wire loop and the lower ends of the four six-inch (15.24 cm) cords are affixed to 90-degree spaced apart segments of a 15-inch (38.10 cm) diameter wire loop.

To complete fabrication of my collapsible artificial Christmas tree, three components are attached to the skeleton just described. First, a conical crown preferably made from a garland of green conifer stems and needles which is supported by the disk and surrounds the lower half of the upwardly projecting member.

Second, an annular wreath made of artificial green garland encircling and held directly beneath the disk by the four cords which join together the disk and the nine-inch (22.86 cm) diameter wire loop.

Third, an elongated garland of artificial green conifer stems and needles which is first wound around the nine-inch (22.86 cm) diameter wire loop and then down around the 12-inch (30.48 cm) diameter wire loop and finally down and around the 15-inch (38.10 cm) diameter wire loop. The encircling annular wreath and the elongated garland wound around the three wire loops together completely cover and hide the disk and all the cords and wire loops thereby creating an artificial conical evergreen tree.

As will be apparent, larger artificial evergreen trees can be constructed by adding a number of additional larger wire loops supported by additional flexible cords and covered by additional lengths of garland. If an artificial conical evergreen tree having a conical angle of slope greater or less than 36 degrees is desired, the diameters of the wire loops need to be modified accordingly.

BEST MODE FOR CARRYING OUT THE INVENTION

Figure 1:
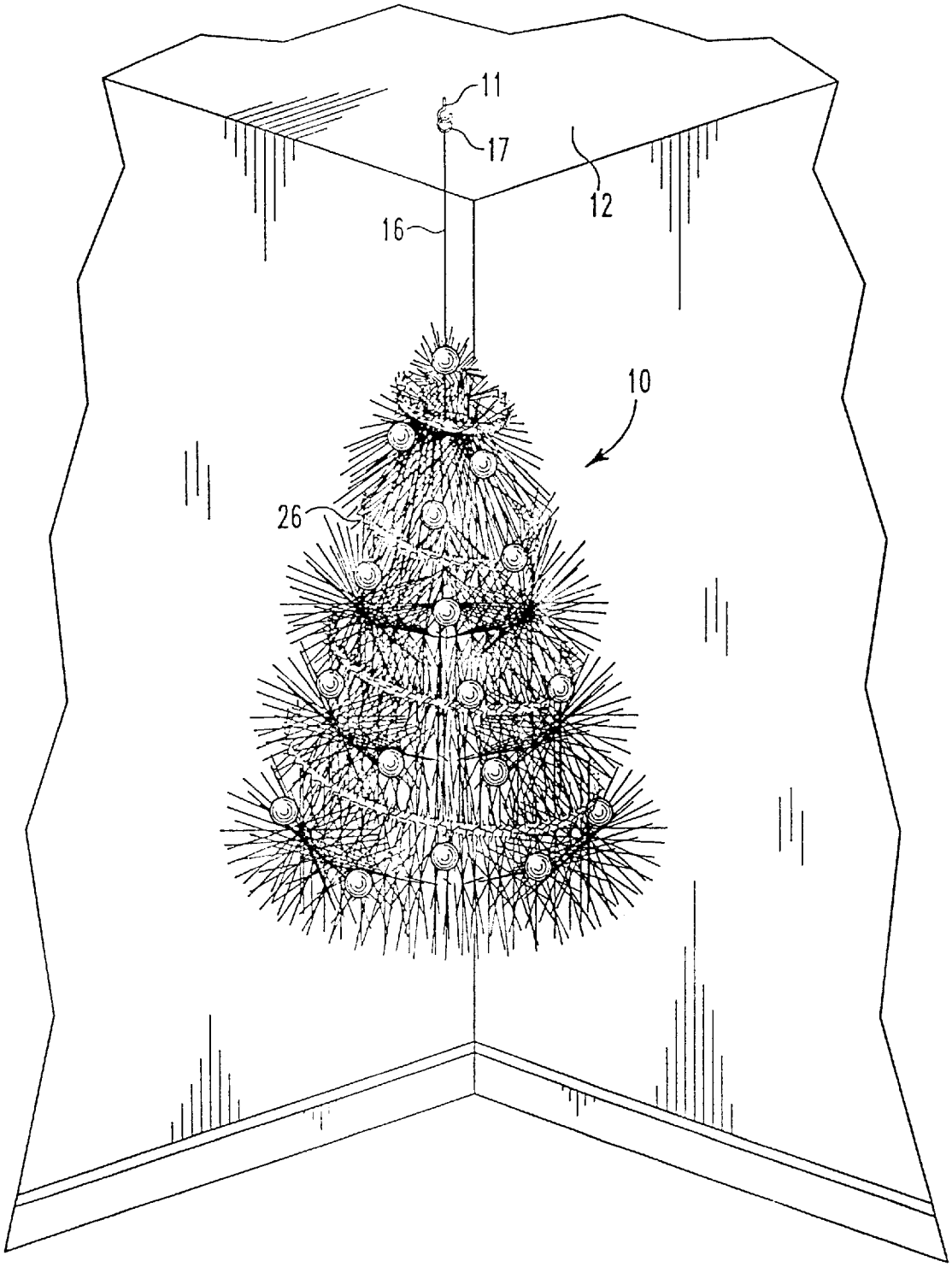
FIG. 1 is a perspective view of a preferred embodiment of my conical evergreen Christmas tree suspended from a ceiling.
Figure 2:
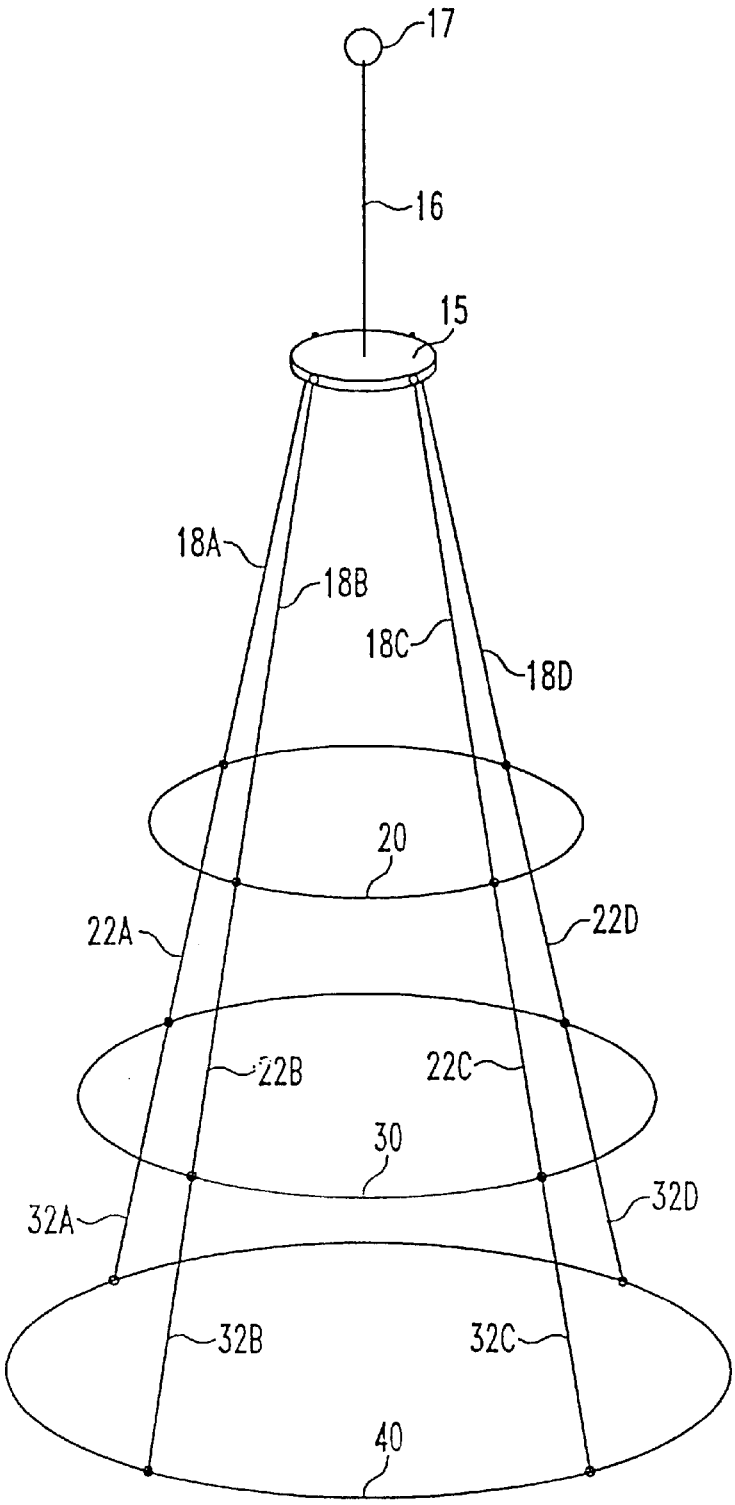
FIG. 2 is a perspective view of the skeleton of a preferred embodiment of my artificial tree.

Referring to FIGS. 1 and 2 of the drawings, evergreen Christmas tree 10 is shown in FIG. 1 suspended from a hook 11 depending from a ceiling 12 and the skeleton of tree 10 shown in FIG. 2 is not visible in FIG. 1.

The skeleton of tree 10 shown in FIG. 2 includes a flat rigid disk 15 preferably made of metal and having a circular outer edge. In the preferred embodiment shown in FIGS. 1 and 2, disk 15 is three inches (7.62 cm) in diameter and affixed to its center is an upwardly projecting member 16 whose upper end includes a ring 17 from which tree 10 is hung.

The upper ends of four ten-inch (25.4 cm) flexible cords 18A, 18B, 18C and 18D are affixed to four segments 90 degrees apart on the outer edge of disk 15 and the lower ends of the cords are affixed to four equally spaced apart segments of circular wire loop 20 as shown in FIG. 2. Wire loop 20 has a diameter of nine inches (22.86 cm) and is preferably made of 18-gauge green painted steel wire having a one-eighth-inch (0.318 cm) diameter.

Then, the upper ends of four six-inch (15.24 cm) flexible cords or wires 22A, 22B, 22C and 22D are affixed to four equally spaced apart segments of wire loop 20 and the lower ends of the four cords are affixed to four equally spaced apart segments of steel wire loop 30 constructed and painted green like wire loop 20. Wire loop 30 has a diameter of 12 inches (30.48 cm).

Finally, the upper ends of four six-inch flexible cords 32A, 32B, 32C and 32D are affixed to equally spaced apart segments of wire loop 30 and the lower ends of the four cords are affixed to four equally spaced apart segments of green painted steel wire loop 40 having a 15-inch (38.10 cm) diameter and lying concentric with loops 20 and 30.

Figure 3:
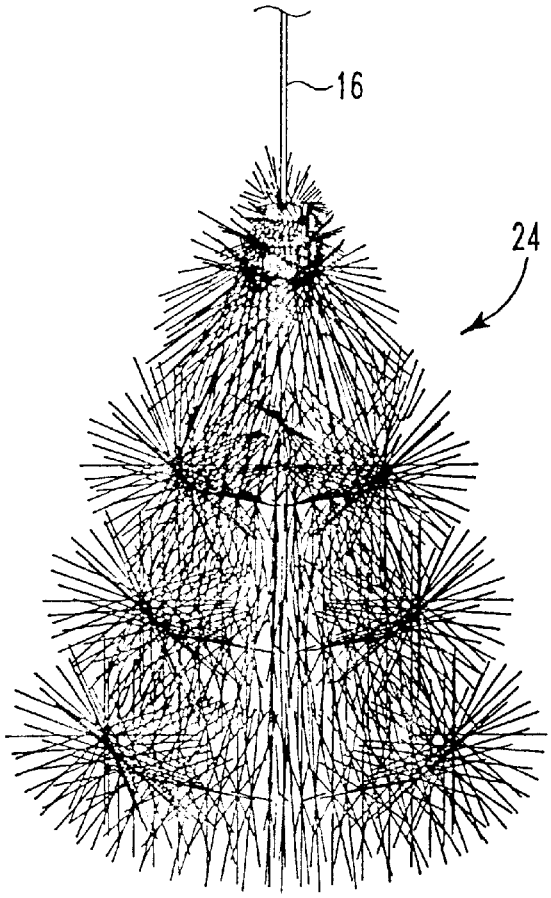
FIG. 3 is a detailed perspective view of a crown made from a garland of artificial green conifer stems and needles used as the top of my artificial tree.
Figure 4:
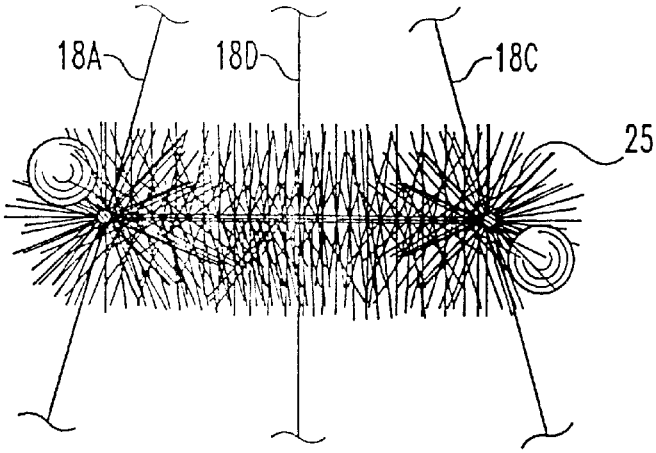
FIG. 4 is a cross-sectional elevational view of a wreath of artificial green garland used in a preferred embodiment of my artificial tree.

The skeleton of tree 10 shown in FIG. 2 is then hidden by covering the skeleton with three components, namely, crown 24 shown in FIG. 3, wreath 25 shown in FIG. 4, and an elongated garland 26 of artificial green conifer stems and needles which may also include various traditional Christmas ornaments and/or electric lights as shown in FIG. 1.

Crown 24 is preferably made of artificial green garland and formed into a cone which rests on disk 15. It is sized to compliment garland 26 beneath disk 15 to form the apex of tree 10 and cover the lower half of member 16 as shown in FIG. 3.

Wreath 25 is made of artificial green garland woven into an annular wreath which is positioned directly beneath disk 15 and supported by cords 18A, 18B, 18C and 18D which, as shown in FIG. 4, run through annular wreath 25.

Directly beneath wreath 25, an elongated garland 26 made of artificial conifer stems and needles is wound first around wire loop 20 and then down around wire loop 30 and finally down around loop 40. The combination of crown 24, wreath 25 and the elongated garland 26 wound around wire loops 20, 30 and 40 serve to completely cover and hide any part of the skeleton, thereby creating an artificial conical Christmas tree capable of being concentrically collapsed into a shallow box for storage.

While not shown in the drawings, my collapsible artificial Christmas tree may be marketed with additional items which permit use of the collapsible artificial tree in locations where there is no overhead support from which the tree might be hung. The additional items include a pole made up of telescoping sections which could be attached to the bottom side of the disk and a stand into which the pole could be nested to support the tree from a floor. The disassembled pole and the stand would fit easily into the collapsed tree's shallow box for storage.

Having disclosed and illustrated a preferred form of my invention, no limitation of the scope and spirit of my invention should be inferred from such disclosure. The scope of my invention is limited only by the appended claims.

I claim:

1. A collapsible artificial tree designed to be displayed suspended from a ceiling comprising:

a flat rigid disk, a member projecting upwardly from the center of the disk and terminating in means from which the artificial tree is suspended, a generally cylindrical crown of artificial green garland surrounding the lower portion of the upwardly projecting member and supported on the disk, a plurality of circular rigid wire loops each having a different diameter;

at least three elongated flexible cords of equal length each having their upper ends affixed to equally spaced apart edge segments of the disk and their lower ends affixed to equally spaced apart segments of the rigid wire loop which has the smallest diameter, at least three elongated flexible cords of equal length each having their upper ends affixed to equally spaced apart segments of the smallest diameter rigid wire loop and their lower ends affixed to equally spaced apart segments of the rigid wire loop having a diameter closest to the rigid wire loop which has the smallest diameter, at least three elongated flexible cords of equal length each having their upper ends affixed to equally spaced apart segments of the rigid wire loop having the second smallest diameter and their lower ends affixed to equally spaced apart segments of the rigid wire loop which has a diameter closest to the rigid wire loop having the second smallest diameter, and an elongated garland of artificial green conifer needles wound first around the rigid wire loop having the smallest diameter and thence down around the rigid wire loop having the second smallest diameter and thence down around the lowermost rigid wire loop to completely cover and hide all the flexible cords and wire loops thereby creating an artificial conical evergreen tree.

2. A collapsible artificial tree designed to be displayed suspended from a ceiling as set forth in claim 1 which includes an annular wreath of artificial green garland encircling and supported beneath the disk by the flexible cords depending from the disk.

3. A collapsible artificial tree designed to be displayed suspended from a ceiling as set forth in claim 1 in which there are four flexible cords affixed to the disk and there are four flexible cords between each spaced apart pair of rigid wire loops.

4. A collapsible artificial tree designed to be displayed suspended from a ceiling as set forth in claim 1 in which additional circular rigid wire loops having successively large diameters are suspended by a plurality of flexible cords in equally spaced apart relation beneath the lowermost rigid wire loop and the elongated garland is wrapped around each of the additional rigid wire loops to completely cover and hide the additional flexible cords and wire loops thereby creating a larger artificial conical evergreen tree.

5. A collapsible conical artificial tree as set forth in claim 1 in which the tree's conical shape measures 36 degrees.

* * * * *